US005120627A

United States Patent [19]

Nozomi et al.

[11] Patent Number: 5,120,627

[45] Date of Patent: Jun. 9, 199

[54] ELECTROPHOTOGRAPHIC PHOTORECEPTOR HAVING A DIP COATED CHARGE TRANSPORT LAYER

[75] Inventors: Mamoru Nozomi, Yokohama; Shigenori Otsuka, Omiya; Hiromi Horiuchi, Tokyo; all of Japan

[73] Assignee: Mitsubishi Kasei Corporation, Tokyo, Japan

[21] Appl. No.: 559,277

[22] Filed: Jul. 30, 1990

[30] Foreign Application Priority Data

Aug. 1, 1989 [JP] Japan ..... 1-99563

[51] Int. Cl.[5] ..... G03G 5/14

[52] U.S. Cl. ..... 430/59; 430/132

[58] Field of Search ..... 430/129, 58, 59, 132

[56] References Cited

U.S. PATENT DOCUMENTS 4,407,919 10/1983 Murayama et al. ..... 430/58

4,943,502 7/1990 Terrell et al. ..... 430/5

4,943,508 7/1990 Yu ..... 430/12

*Primary Examiner*—John Goodrow

*Attorney, Agent, or Firm*—David G. Conlin; Linda M. Buckley

[57] ABSTRACT

Disclosed herein is an electrophotographic photorecep tor having on a conductive base at least one charg generation layer and at least one charge transport layer said charge transport layer having the thickness of 2 μm or above and being formed with a coating solutio containing a condensation polymer of the viscosity average molecular weight of 15,000 to 25,000 as binder resin according to the dip coating method. Th electrophotographic photoreceptor according to th present invention has the excellent durability becaus the resultant charge transport layer has the increase and uniform thickness without changing the electri properties, especially the charged potential.

12 Claims, 1 Drawing Sheet

ELECTROPHOTOGRAPHIC PHOTORECEPTOR HAVING A DIP COATED CHARGE TRANSPORT LAYER

FIELD OF THE INVENTION

Figure 1:
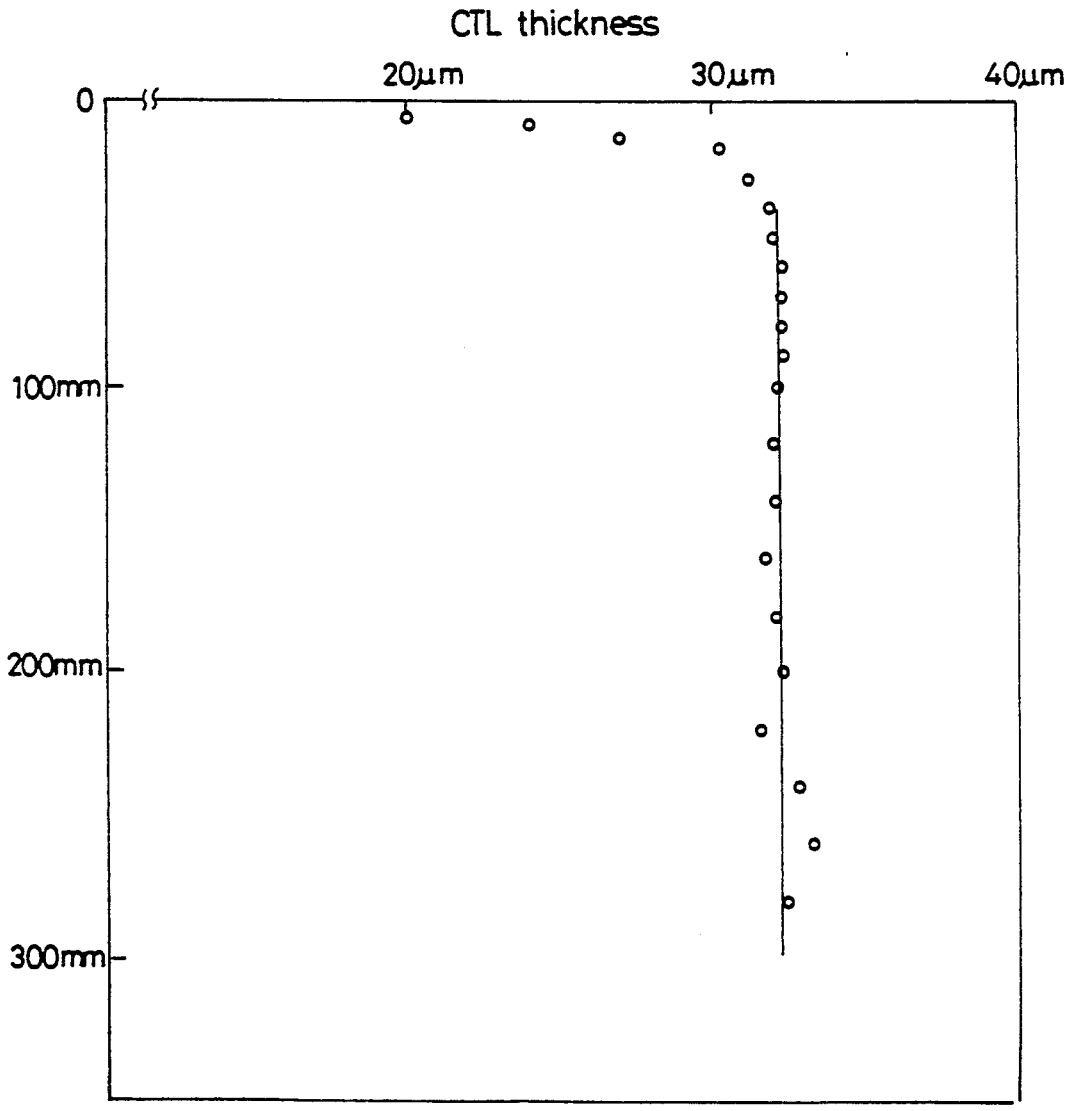

The present invention relates to an electrophotographic photoreceptor. More particularly, it relates to the electrophotographic photoreceptor having an excellent durability.

BACKGROUND OF THE INVENTION

In recent years, the electrophotography has been applied to copying machines as well as various printers since they can give images with high qualities without delay. As a photoreceptor which plays an important role in the electrophotography, the photoreceptor comprising an inorganic photoconductive material such as selenium, arsenic-selenium alloy, cadmium sulfide, zinc oxide and the like has been used. More recently, the photoreceptor comprising an organic photoconductive material was proposed. The latter has the advantages which is not a pollutant and which has a film-formability and a shapability.

As one of the organic photoreceptors, the so-called "laminated-type photoreceptor" in which a charge generation layer, the thickness of which is usually about 0.5 μm, and a charge transport layer, the thickness of which is usually about 10 to 20 μm, are successively laminated was developed. The laminated-type photoreceptor is increasingly interested in and is expected to be widely used in the near future because it has the following advantages:

(1) the photoreceptor having high sensitivity can be obtained by suitably selecting and combining the charge generation material and the charge transport material;

(2) the photoreceptor having high safety can be obtained because the charge generation material and the charge transport material can be selected from a wide range of the materials; and (3) the photoreceptor can be prepared by simple coating and thus it can be prepared with low costs.

In general, a photosensitive layer comprising the charge generation layer and the charge transport layer is formed on a conductive base according to any one of the known methods such as a dip coating method, a spray method, a wire bar method, a blade method, a roller method, a curtain coater method and so on. When the conductive base is an endless pipe, the dip coating method wherein an object to be coated is dipped in a vessel containing a coating solution followed by lifting the object from the surface of the coating solution at a constant speed is usually and preferably employed because it can give a coated film with an uniform thickness relatively easily.

The prior laminated-type photoreceptors are very poor in durability when compared with the inorganic photoreceptors so as to limit their application.

One important cause of such a poor durability is that the thickness of the charge transport layer reduces by being subjected to the abrasion during the cleaning step of the electrophotographic process. The reduction in thickness of the charge transport layer is accompanied by the lowering of the charged potential and thus the lowering of the contrast on the resultant images. As one of the effective means for preventing the reduction in thickness of the charge transport layer, it is proposed to increase the thickness of the charge transport layer so to prevent the change of the charged potential.

The approach of increasing the thickness of t charge transport layer has two problems. Firstly, t charge transport layer with the increased and unifor thickness cannot be obtained according to the conve tional dip coating method because a large volume of t coating solution drop down and the coating cannot conducted at the suitable speed. For effectively formi the charge transport layer with the increased and u form thickness according to the dip coating method, t use of the low molecular weight polymer as a bind resin so as to prepare the coating solution having t high solid concentration and the reduced viscosity considered. However, the abrasion resistance of t charge transport layer is impaired when this coati solution is used, and as the result, the advantage effect by increasing the thickness of the charge transport lay will be compensated.

Secondly, when the thickness of the charge transpo layer increases, the photoreceptor has the low optic responsiveness. Because, the increase of the thickness the charge transport layer weakens the electric fie strength which affects the mobility of carriers and t optical responsiveness of the photoreceptor.

An object of the present invention is to provide t electrophotographic photoreceptor having the exc lent durability and the excellent electric properties f long period, which can be easily and efficiently pr pared.

The present inventors found that the above object the present invention can be achieved by forming t thicker charge transport layer with the coating soluti containing a specific polymer as the binder resin a cording to the dip coating method.

SUMMARY OF THE INVENTION

The present invention provides the electrophot graphic photoreceptor which has on a conductive ba at least one charge generation layer and at least o charge transport layer, the charge transport layer ha ing the thickness of 27 μm or above and being form with the coating solution containing a condensati polymer of the viscosity-average molecular weight 15,000 to 25,000 as the binder resin according to the d coating method.

DETAILED EXPLANATION OF THE INVENTION

The photoreceptor according to the present inve tion has the conductive base, on which the photosen tive layer comprising the charge generation layer a the charge transport layer is provided. As the condu tive base, any of the known conductive bases usual used in the electrophotographic photoreceptor can used. Examples of the conductive base include a ba made of a metallic material such as aluminium, stainle steel, copper and nickel and a base made of an insulati material such as polyester film or paper which has conductive layer such as a layer of aluminium, copp palladium, tin oxide and indium oxide. Among them, endless pipe of metal such as aluminium is preferable A known barrier layer may be provided between t conductive base and the charge generation layer, generally used in the photoreceptor. As the barri layer, a layer of an inorganic material such as aluminiu anodic oxide film, aluminium oxide and aluminium h droxide or a layer of an organic material such as poly yl alcohol, casein, polyvinyl pyrrolidone, polyacrylic cid, celluloses, gelatin, starch, polyurethane, polyimide nd polyamide is used.

The charge generation layer comprises a charge gen- ration material and a binder resin. As the charge gener- tion material used in the charge generation layer, vari- us inorganic photoconductive materials such as sele- ium and its alloys, arsenic-selenium alloy, cadmium ılfide and zinc oxide or various organic pigment or dye ıch as phthalocyanine, azo, quinacridone, polycyclic uinone, pyrylium salt, thiapyrylium salt, indigo, thioin- igo, anthoanthrone, pyranthrone and cyanine can be sed. Among them, phthalocyanine without metal, hthalocyanines coordinated with metal or its com- ound such as copper, indium chloride, gallium chlo- ide, tin, oxytitanium, zinc and vanadium, azo pigments ıch as monoazo, bisazo, trisazo and polyazo are prefer- ble.

As the binder used together with the charge genera- on material in the charge generation layer, any of the inder resins usually used in the charge generation layer an be used. Examples of the resins include resins such s polyvinyl acetate, polyacrylate, polymethacrylate, olyester, polycarbonate, polyvinyl acetal, polyvinyl ropional, polyvinyl butyral, phenoxy resin, epoxy esin, urethane resin, cellulose ester and cellulose ether.

The charge generation material is used in an amount f 20 to 300 parts by weight, preferably 30 to 200 parts y weight per 100 parts by weight of the binder resin.

If necessary, the charge generation layer may contain arious additives such as a leveling agent, an antioxi- ant and a sensitizer.

The thickness of the charge generation layer is gener- ly 0.1 to 1 μm, preferably 0.15 to 0.6 μm.

The charge generation layer can be formed on the onductive base according to any one of the known ıethods, preferably the dip coating method.

The charge transport layer comprises a charge trans- ort material and a binder resin.

As the charge transport material used together with ıe binder resin in the charge transport layer, high molecular weight compounds such as polyvinyl carbazole, polyvinyl pyrene and polyacenaphthylene and low molecular weight compounds such as pyrazoline derivatives, oxazole derivatives, hydrazone derivatives, stilbene derivatives and amine derivatives are exemplified.

In the charge transport layer according to the present invention, the condensation polymer is used as the binder resin. The condensation polymer used should have the viscosity-average molecular weight of 15,000 to 25,000. Herein the viscosity-average molecular weight of the polymer is calculated from the following equation.

$$[\eta]=K[Mv]^{\alpha}$$

wherein

Mv is viscosity-average molecular weight, $\eta$ is intrinsic viscosity,

K and $\alpha$ are constants depending on the natures of polymer and solvent used and the determination temperature. When the condensation polymer having the viscosity-average molecular weight (Mv) of less than 15,000 is used, the mechanical strength of the polymer itself is very low and thus the resultant charge transport layer has the poor abrasion resistance. On the other hand, when the condensation polymer having the viscosity-average molecular weight (Mv) of above 25,000 is used, the problems such as that the coating speed for obtaining the coated film with the desired thickness is very slow, that the times required for coating is very long and that the thickness of the coated film is not uniform are caused.

As the condensation polymer usable in the present invention, resins of polycarbonate, polyester, polysulfone, polyether, polyketone, polyimide, polyester carbonate, polybenzimidazole, polyether ketone, phenoxy and epoxy are exemplified. Among them, polycarbonate, polyester and/or polyester carbonate resins having repeating units which are represented by the following formulas (I) to (IV) are preferable with respect to electric properties.

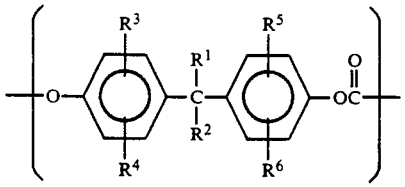

(I)

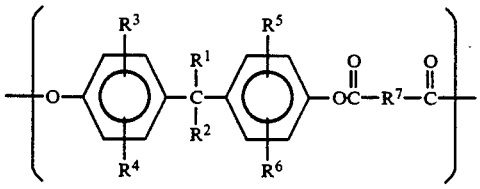

(II)

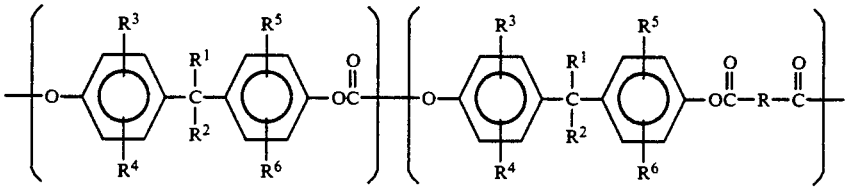

(III)

-continued (IV)

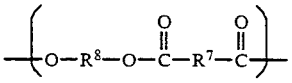

In the above formulas, $R^1$ and $R^2$ are independently hydrogen atom, alkyl group containing 1 to 3 carbon atoms, trifluoromethyl group or phenyl group. Alternatively, $R^1$ together with $R^2$ may form cycloalkylidene group such as cyclohexylene. $R^3$, $R^4$, $R^5$ and $R^6$ are independently hydrogen atom, halogen atoms or alkyl group containing 1 to 3 carbon atoms. $R^7$ is a residue of divalent acid such as terephthalic acid, isophthalic acid, 2,6-naphthalenedicarboxylic acid and diphenic acid. $R^8$ is alkylene group containing 2 to 6 carbon atoms ( 2,2-bis(4-hydroxycyclohexyl)propane.

The preferably repeating units in the condensatic polymer are shown below. In the formulas,

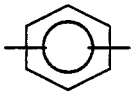

represents para- or meta-substitution.

polycarbonate resin

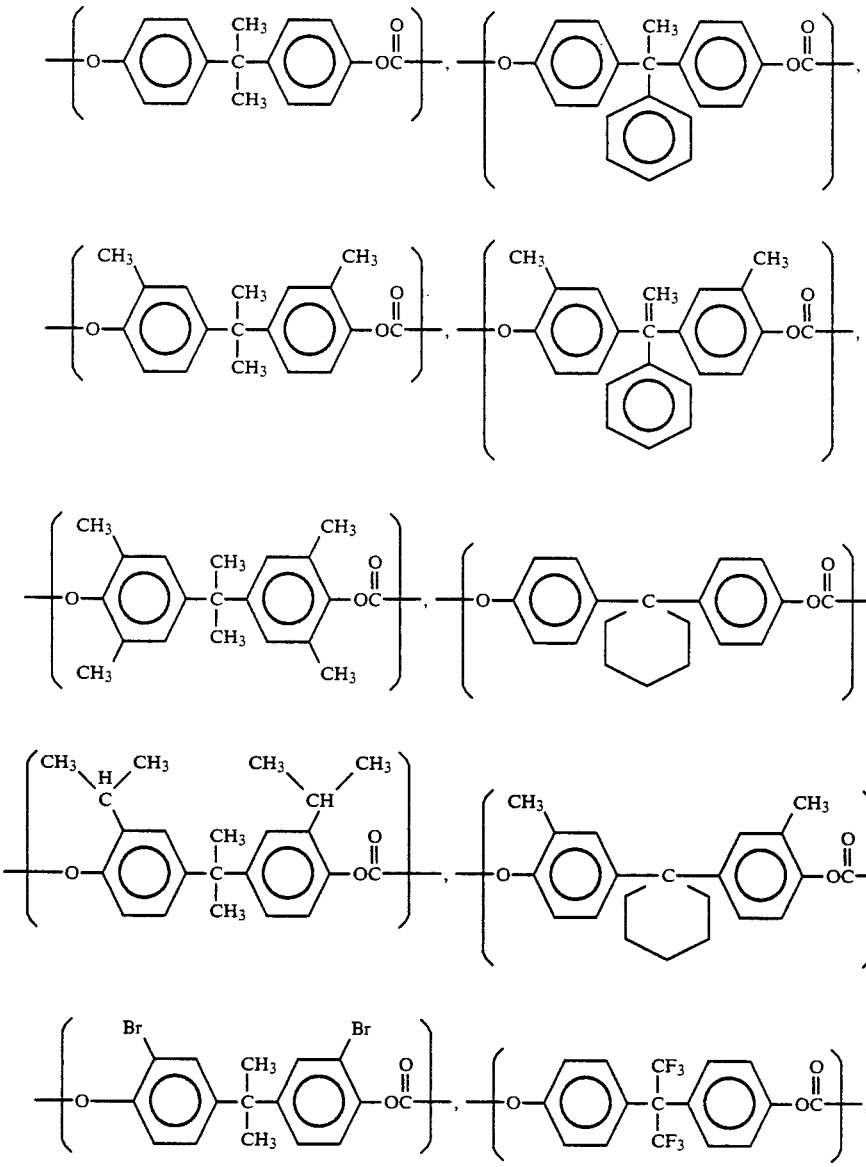

-continued
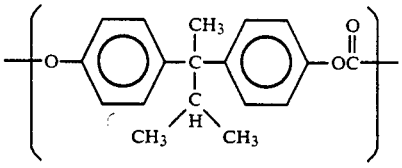
polyester resin
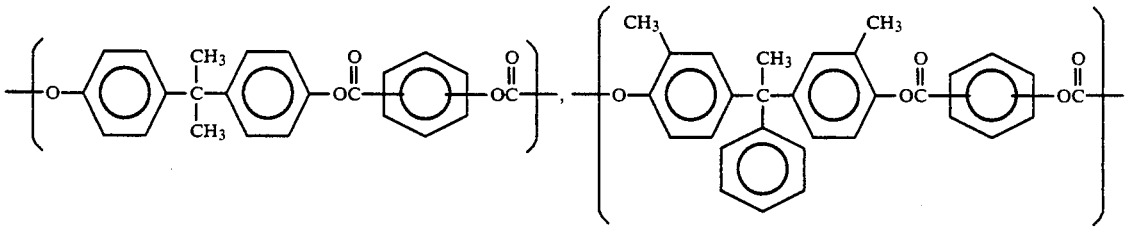
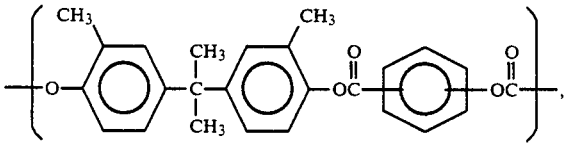
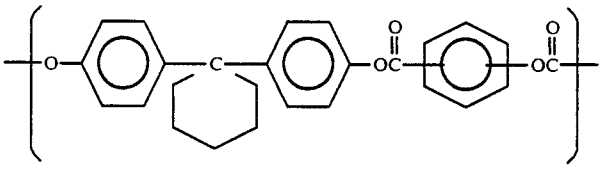
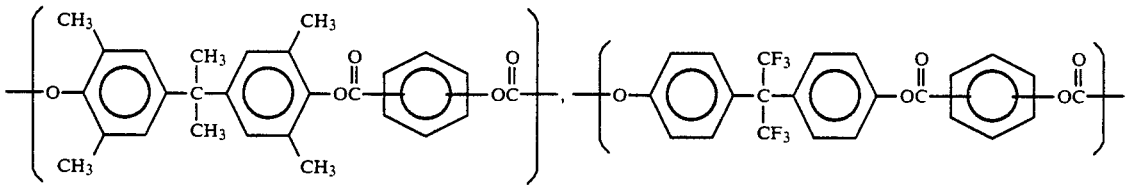
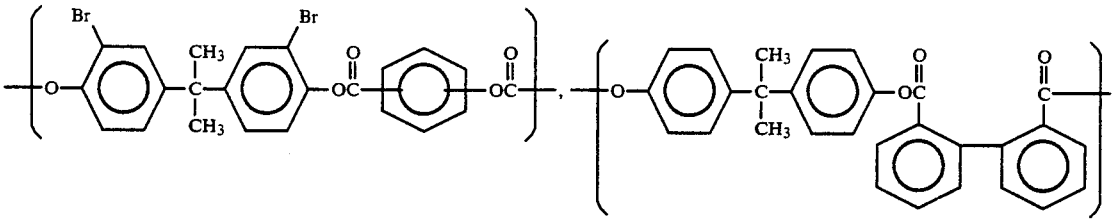
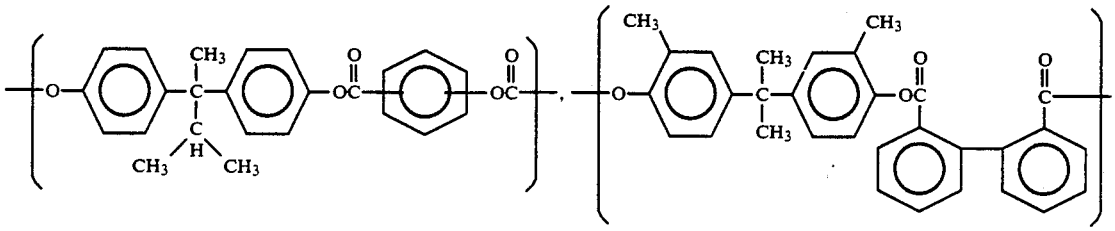

-continued
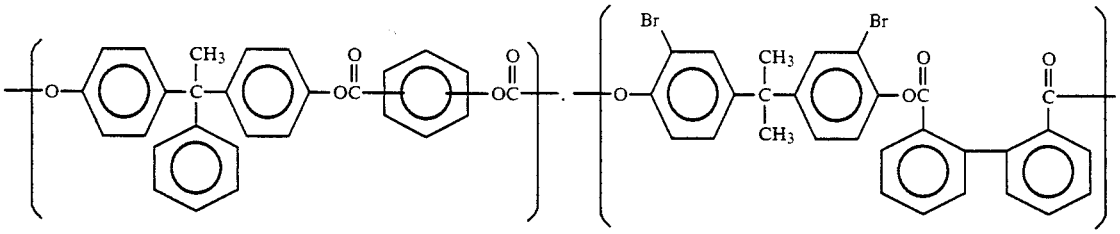
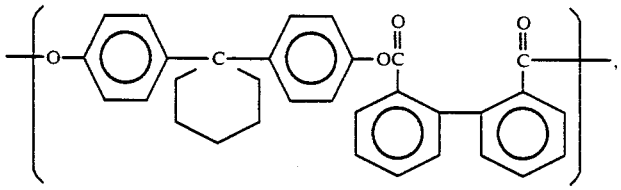
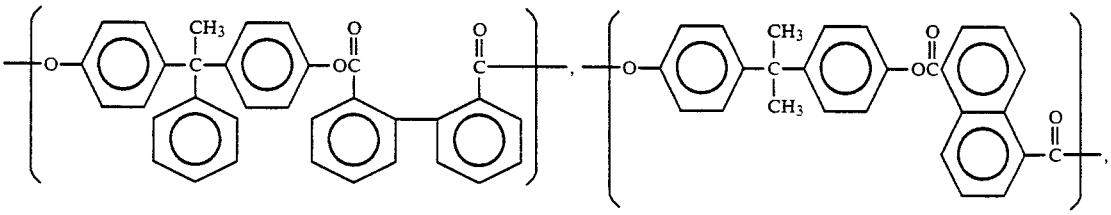
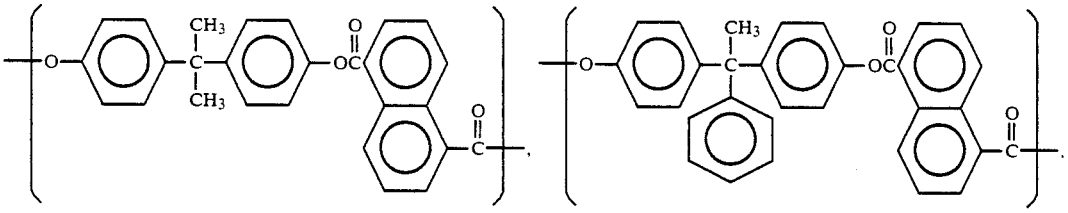
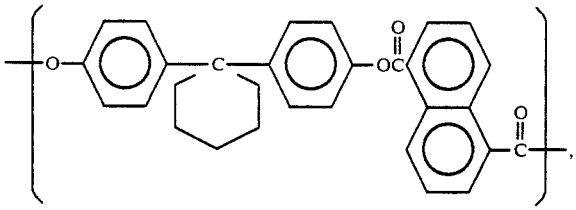
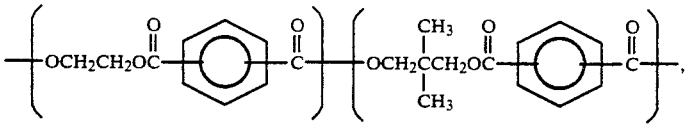
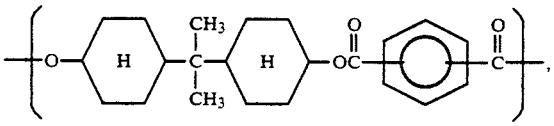
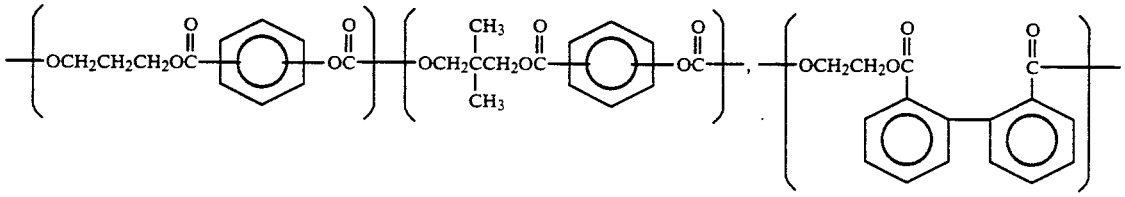

-continued
polyester carbonate resin
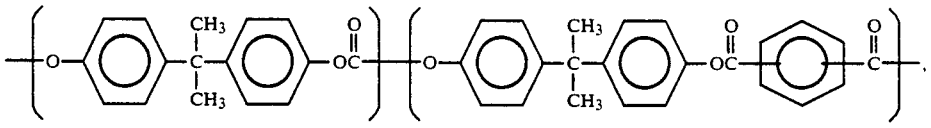
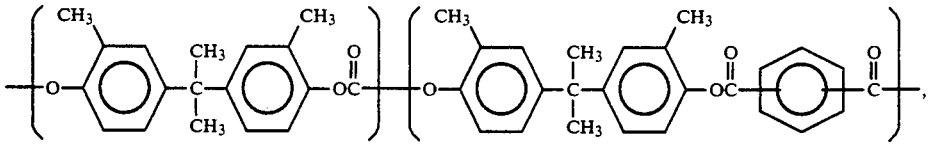
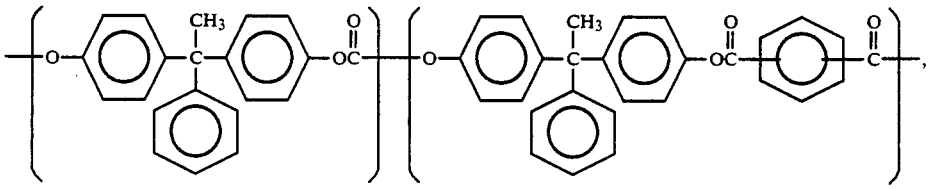
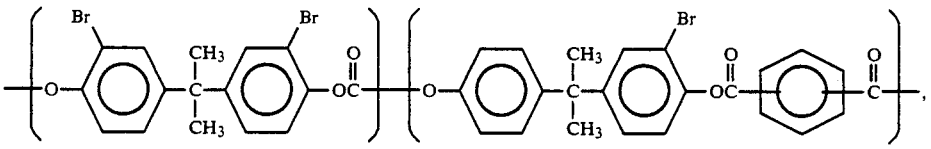
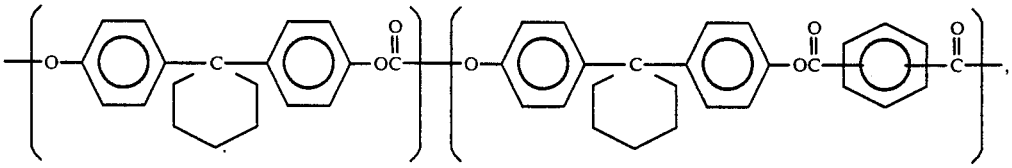
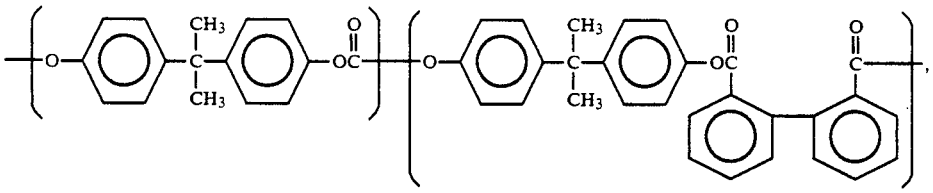
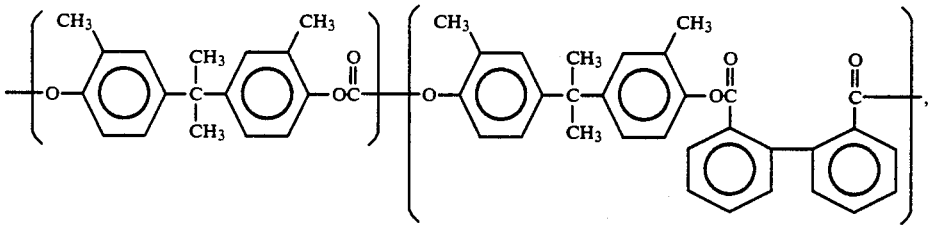
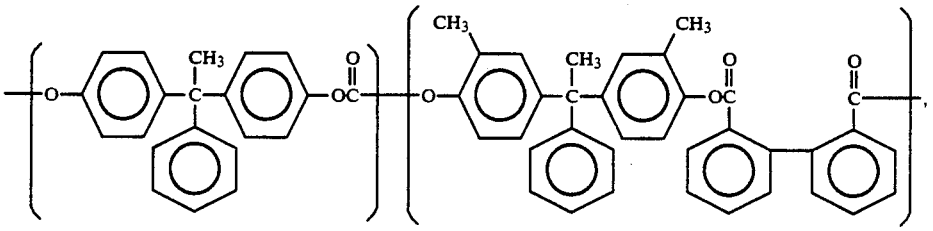

-continued

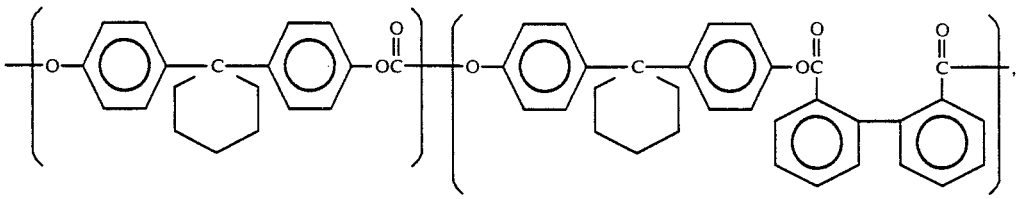

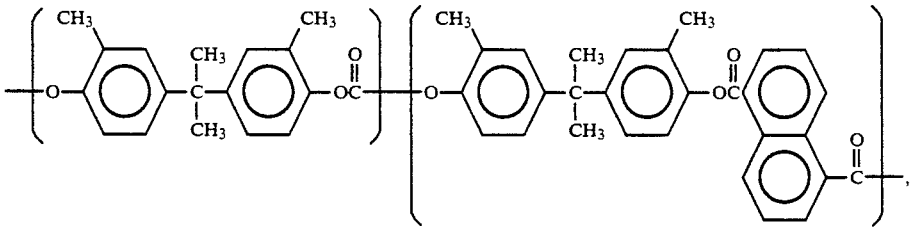

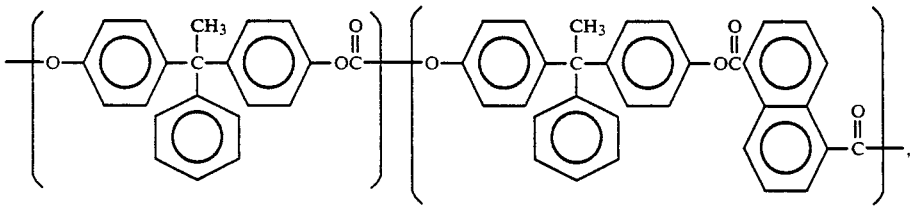

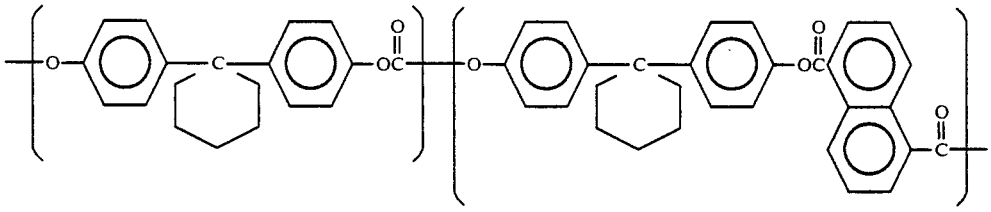

These condensation polymers may be homopolymers or copolymers copolymerized with other comonomers. Alternatively, the condensation polymer may be used in a mixture with other condensation polymer(s). In the polyester carbonate resins, the ratios of carbonate components to ester components can be freely and suitably varied.

The charge transport material is generally used in an amount of 30 to 200 parts by weight, preferably 50 to 150 parts by weight per 100 parts by weight of the binder resin.

If necessary, the charge transport layer may contain various additives such as an antioxidant, a sensitizer and a levelling agent.

The thickness of the charge transport layer should be at least 27 μm. Preferably, it is 30 to 50 μm.

The charge transport layer is prepared on the charge generation layer according to the dip coating method. For this purpose, the coating solution containing the charge transport material, the binder resin and optionally the additives in a solvent is used. It is preferable for efficiently obtaining the charge transport layer with the uniform thickness to use the coating solution preferably having the solid concentration of 25% or above and preferably not more than 35% and having the viscosity of 50 to 300 cPs, preferably 50 to 200 cPs. As the solvent used, the solvent having the boiling point of 35 to 150° C. is preferable since it can be air-dried at a suitable speed. Examples of the suitable solvents are mentioned below. Aromatic hydrocarbons such as benzene, toluene and xylene; ketones such as acetone, methyl eth ketone, diethyl ketone, methyl isobutyl ketone, cycl hexanone and cyclopentanone; esters such as meth acetate, methyl propionate, methyl cellosolve and eth cellosolve; alcohols such as methanol, ethanol, prop nol and butanol; ethers such as tetrahydrofuran, dio ane, dimethoxymethane, dimethoxyethane and diglym halogenated hydrocarbons such a carbon tetrachlorid chloroform, methylene chloride, dichloroethane, t chloroethane and chlorobenzene; amides such as N,N dimethylformamide and N,N-dimethylacetamide; ar dimethylsulfoxide. The solvent may be used in a mi ture.

In the preparation of the charge transport layer a cording to the dip coating method, the coating speed controlled so as to obtain the coated film with the thic ness of 27 μm or above, preferably 30 to 50 μm. Here the coating speed means the speed of lifting the obje to be coated from the surface of the coating solutio About 30 to 80 cm/min is suitable. When the coatir speed is less than about 30 cm/min, the satisfacto productivity cannot be achieved. On the other han when the coating speed is above 80 cm/min, the coate film with the uniform thickness cannot be obtained d to the effect of the vibration of the coating apparatu

EXAMPLES

The invention will be better understood by referen to certain examples, which are included herein for pu oses of illustration only and are not intended to limit ıe invention.

EXAMPLE 1

10 parts by weight of a bisazo compound having the ›llowing formula:

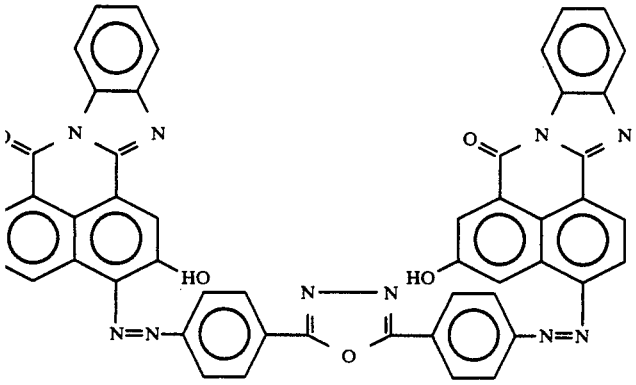

as added to 150 parts by weight of 4-methoxy-4-ethylpentanone-2 and they were subjected to the ·inding and dispersion treatment with a sand grind ill. The thus obtained dispersion was added to 200 ırts by weight of a 5% solution of 1,2-dimethoxyeıane in polyvinyl butyral (#6000-C (trade name), ex ENKI KAGAKU KOGYO KABUSHIKI KAIHA) so as to prepare a dispersion with the solid conıntration of 4.0%.

In the above dispersion, an aluminium cylinder havg a mirror finished surface and having the outer diamer of 80 mm, the length of 340 mm and the thickness ' 1.0 mm was dipped and a charge generation layer as coated on the aluminium cylinder to provide a ied film with the thickness of 0.3 μm.

Then, this aluminium cylinder was dipped in a coatg solution at the coating speed of 40 cm/min so as to ›at the charge transport layer on the charge generaɔn layer. The coating solution contained 95 parts by eight of a hydrazone compound having the following rmula:

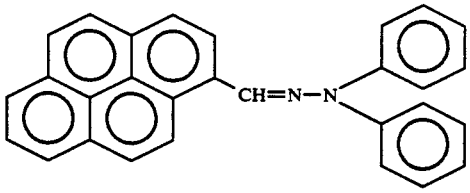

5 parts by weight of a cyano compound having the llowing formula:

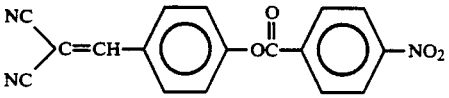

d 100 parts by weight of polycarbonate resin having e viscosity-average molecular weight of 24,400 and e following repeating unit:

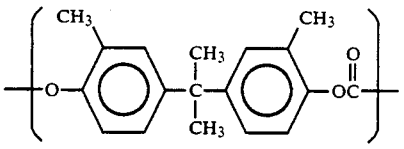

in a mixed solvent of dioxane and tetrahydrofuran and had the solid concentration of 27.5% and the viscosity of 195 cPs. The charge transport layer was dried at room temperature for 30 minutes and 125° C. for 20 minutes to provide a dried film with the thickness of 32 μm.

The distribution in thickness of the charge transport layer from the edge where was firstly lifted from the coating solution was determined. The result is shown in FIG. 1. Its ordinate is a distance from the edge and its abscissa is the thickness of the coated film. As shown in FIG. 1, the charge transport layer at 20 mm from the edge had the thickness corresponding to 95% of the average. From this result, it can be said that the charge transport layer having the uniform thickness could be obtained efficiently according to the present invention.

EXAMPLE 2

The procedure of Example 1 was repeated, except that the coating solution for the charge transport layer which contained the polycarbonate resin of the viscosity-average molecular weight of 20,300 and had the solid concentration of 30% and the viscosity of 120 cPs was used so as to provide the dried film of the charge transport layer with the thickness of 40 μm. Then, the coating speed was controlled to be 48 cm/min.

The charge transport layer at 18 mm from the edge had the thickness corresponding to 95% of the average.

COMPARATIVE EXAMPLE 1

The procedure of Example 1 was repeated, except that the coating solution for the charge transport layer which contained the polycarbonate resin of the viscosity-average molecular weight of 31,000 and had the solid concentration of 30% and the viscosity of 520 cPs was used so as to provide the dried film of the charge transport layer with the thickness of 40 μm. Then, the coating speed was controlled to be 18 cm/min and the long coating period was required.

The charge transport layer at 25 mm from the edge had the thickness corresponding to 95% of the average.

COMPARATIVE EXAMPLE 2

The procedure of Example 1 was repeated, except that the coating solution for the charge transport layer which contained the polycarbonate resin of the viscosity-average molecular weight of 31,000 and had the solid concentration of 23% and the viscosity of 120 cPs was used so as to provide the dried film of the charge transport layer with the thickness of 40 μm. Then, the coating speed was controlled to be 200 cm/min.

The charge transport layer at 120 mm from the edge had the thickness corresponding to 95% of the average.

It was observed that a large volume of the coating solution dropped down.

COMPARATIVE EXAMPLE 3

The procedure of Example 1 was repeated, except that the coating solution for the charge transport layer which contained the polycarbonate resin of the viscosity-average molecular weight of 31,000 and had the solid concentration of 23% and the viscosity of 120 cPs was used so as to provide the dried film of the charge transport layer with the thickness of 20 μm. Then, the coating speed was controlled to be 56 cm/min.

The charge transport layer at 18 mm from the edge had the thickness corresponding to 95% of the average.

EXAMPLE 3

The procedure of Example 1 was repeated, except that the coating solution for the charge transport layer which contained the polyester resin having the viscosity-average molecular weight of 22,000 and the following repeating unit:

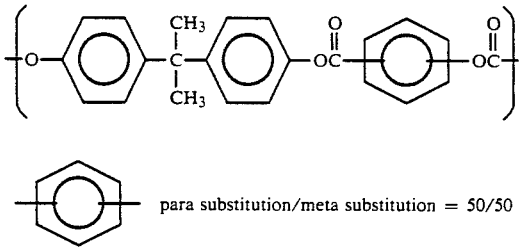

and had the solid concentration of 27% and the viscosity of 110 cPs was used so as to provide the dried film of the charge transport layer with the thickness of 35 μm. Then, the coating speed was controlled to be 40 cm/min.

The charge transport layer at 22 mm from the edge had the thickness corresponding to 95% of the average.

EXAMPLE 4

The procedure of Example 1 was repeated, except that the coating solution for the charge transport layer which contained the polyester carbonate resin having the viscosity-average molecular weight of 24,100 and the following repeating unit:

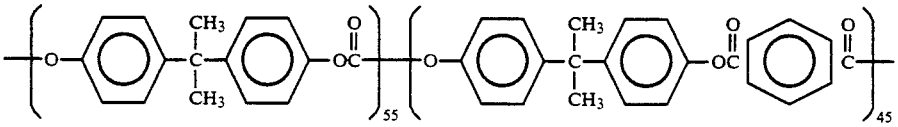

and has the solid concentration of 26% and the viscosity of 120 cPs was used so as to provide the dried film of the charge transport layer with the thickness of 35 μm. Then the coating speed was controlled to be 3 cm/min.

The charge transport layer at 24 mm from the edge had the thickness corresponding to 95% of the average.

EXAMPLE 5

The procedure of Example 1 was repeated, except that the coating solution for the charge transport layer which contained the polyester resin having the viscosity-average molecular weight of 18,000 and the following repeating unit:

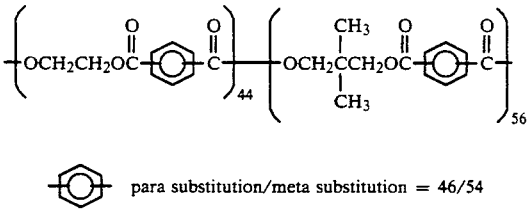

and had the solid concentration of 32% and the viscosity of 80 cPs was used so as to provide the dried film of the charge transport layer with the thickness of 45 μm. Then the coating speed was controlled to be 5 cm/min.

The charge transport layer at 15 mm from the edge had the thickness corresponding to 95% of the average.

EXAMPLE 6

10 parts by weight of oxythtanium phthalocyanine was added to 150 parts by weight of 4-methoxy-4-methylpentanone-2 and they were subjected to the grinding and dispersion treatment with a sand grinder mill. The thus obtained dispersion was added to 10 parts by weight of a 5% solution of 1,2-dimethoxyethane in polyvinyl butyral (#6000-C (trade name), DENKI KAGAKU KOGYO KABUSHIKI KAISHA) while applying the ultrasonic (29 KHz) so as to prepare a dispersion with the solid concentration of 4.0%.

In the above dispersion, an aluminium cylinder having a mirror finished surface and having the outer diameter of 30 mm, the length of 260 mm and the thickness of 0.75 mm was dipped and a charge generation layer was coated on the aluminium cylinder to provide a dried film with the thickness of 0.3 μm.

Then, this aluminium cylinder was dipped in the coating solution used in Example 2 at the coating speed of 40 cm/min so as to coat the charge transport layer on the charge generation layer. The charge transport layer was dried at room temperature for 30 minutes and 125 C. for 20 minutes to provide a dried film with the thickness of 32 μm.

The charge transport layer at 14 mm from the edge had the thickness corresponding to 95% of the average.

EXAMPLES 7 TO 9

The procedure of Example 1 was repeated, except ıat the charge transport material shown in Table 1 was ;ed in place of the hydrazone compound and the cyano ɔmpound.

TABLE 1

| :x. | charge transport material | solid concentration | viscosity |
|---|---|---|---|
| 7 | 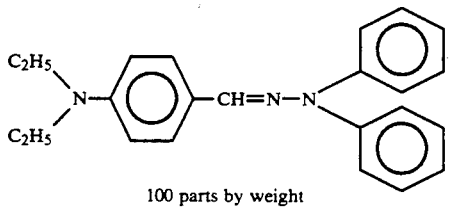 100 parts by weight | 27.5% | 195 cPs |
| 8 | 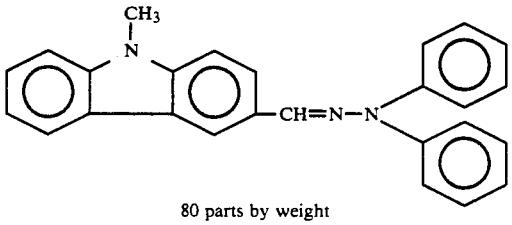 80 parts by weight 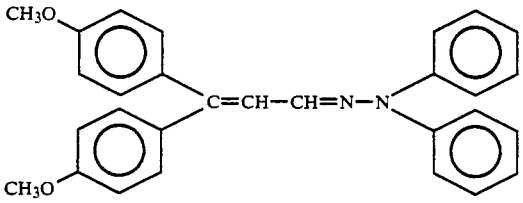 20 parts by weight | 27.5% | 196 cPs |
| 9 | 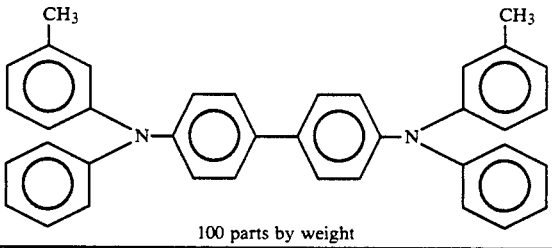 100 parts by weight | 27.5% | 196 cPs |

The coating speed and the distance from the edge here had the thickness corresponding to 95% of the ʼerage in each Examples are shown in Table 2. From is result, it can be said that the charge transport layer ıving the uniform thickness could be obtained effi-ently according to the present invention. It was ob-rved that the dropping of the coating solution was tle.

TABLE 2

| Ex. | coating speed | distance from the edge |
|---|---|---|
| 7 | 38 cm/min | 18 mm |
| 8 | 40 cm/min | 20 mm |
| 9 | 40 cm/min | 20 mm |

TEST EXAMPLE

The photoreceptors prepared in Example 2 and Com-ırative Example 3 were subjected to the practical ɔpying operation using the commercial copying ma-ıine (ex Sharp Corporation, SF-8200). The back-ound potential, the initial potential and the thickness of the charge transport layer (CTL) were determined. After the copying operation was repeated 20,000 times, the same determinations were carried out. The results are shown in Table 3.

TABLE 3

| | Example 2 | | Comparative Example 3 | |
|---|---|---|---|---|
| | ini-tial | after 20,000 times | ini-tial | after 20,000 times |
| initial potential (V) | 700 | 610 | 700 | 490 |
| background potential (V) | 20 | 65 | 15 | 55 |
| CTL thickness (μm) | 40 | 35 | 20 | 15 |

As clear from the results in Table 3, the reduction in thickness of the charge transport layer was very small according to the present invention and as the result, the photoreceptor according to the present invention has the excellent electric properties during long period.

EFFECT OF THE INVENTION

The electrophotographic photoreceptor according to the present invention can have the charge transport layer with the increased and uniform thickness owing to the use of the specific binder polymer in the charge transport layer. According to the present invention, the above charge transport layer can be prepared very efficiently owing to the use of the conventional dip coating method. In addition, the photoreceptor according to the present invention has the excellent durability because the charge transport layer has the sufficient abrasion resistance and therefore, when the photoreceptor is repeatedly used, the reduction in the thickness of the charge transport layer is very little and the change in the electric properties, especially the charged potential is very small.

What is claimed is:

1. A method for preparation of an electrophotographic photoreceptor which has on a conductive base at least one charge generation layer and at least one charge transport layer, characterized in that said charge transport layer is formed into a thickness of 27 μm or above according to a dip coating method with a coating solution which contains a condensation polymer of the viscosity-average molecular weight of 15,000 to 25,000 as a binder resin, the solid concentration of which is 25% or more and the viscosity of which is 50 to 300 cPs.

2. The method according to claim 1, wherein the condensation polymer is at least one resin selected from the group consisting of polycarbonate, polyester, polysulfone, polyether, polyketone, polyimide, polyester carbonate, polybenzimidazole, polyether ketone, penoxy and epoxy.

3. The method according to claim 2, wherein the condensation polymer is polycarbonate, polyester and/or polyester carbonate resin having repeating units which are represented by the following formulas (I) to (IV);

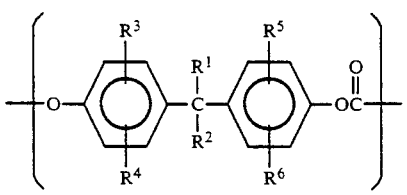

(I)

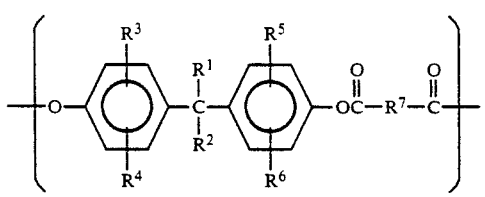

(II)

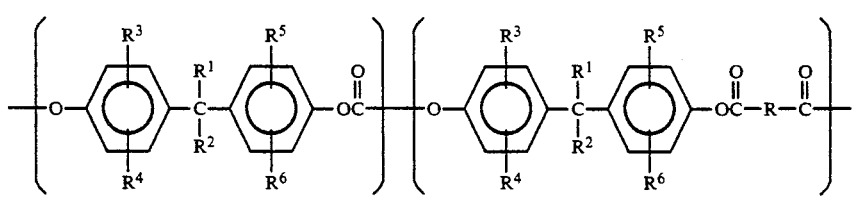

(III)

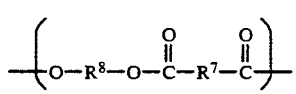

(IV)

wherein $R^1$ and $R^2$ are independently hydrogen atom, alkyl group containing 1 to 3 carbon atoms, trifluoromethyl group or phenyl group, or alternatively $R^1$ together with $R^2$ may form cycloalkylidene group; $R^3$, $R^4$, $R^5$ and $R^6$ are independently hydrogen atom, halogen atoms or alkyl group containing 1 to 3 carbon atoms; $R^7$ is a residue of divalent acid; and $R^8$ is alkylene group containing 2 to 6 carbon atoms or 2,2-bis(4-hydroxycyclohexyl)propane.

4. The method according to claim 1, wherein the charge transport layer has the thickness of 30 to 50 μm.

5. The method according to claim 1, wherein the solid concentration of the coating solution is 35% or less.

6. The method according to claim 1, wherein the viscosity of the coating solution is 50 to 200 cPs.

7. The method according to claim 1, wherein the coating speed of the coating solution is 30 to 80 cm/min.

8. The method according to claim 1, wherein the charge transport layer contains a charge transport material selected from the group consisting of polyvinylcarbazole, polyvinyl pyrene, polyacenaphthylene, pyrazoline derivative, oxazole derivative, hydrazone derivative, stilbene derivative and amine derivative.

9. The method according to claim 1, wherein the charge transport layer comprises a charge transport material and the binder resin and the amount of the charge transport material is 30 to 200 parts by weight per 100 parts by weight of the binder resin.

10. The method according to claim 9, wherein the amount of the charge transport material is 50 to 150 parts by weight per 100 parts by weight of the binder resin.

11. The method according to claim 1, wherein the coating solution contains a solvent having a boiling point of 35° to 150° C.

12. The method according to claim 11, wherein the solvent is aromatic hydrocarbons, ketones, esters, alcohols, ethers, halogenated hydrocarbons, amides or dimethylsulfoxide.

* * * * *

UNITED STATES PATENT AND TRADEMARK OFFICE

CERTIFICATE OF CORRECTION

PATENT NO. : 5,120,627

DATED : June 9, 1992

INVENTOR(S) : Nozomi et al.

It is certified that error appears in the above-identified patent and that said Letters Patent is hereby corrected as shown below:

ON TITLE PAGE: item [30] replace "1-99563" with --1-199563--

Signed and Sealed this

Seventh Day of September, 1993

Bruce Lehman

*Attest:*

BRUCE LEHMAN

*Attesting Officer*

*Commissioner of Patents and Trademarks*